US005984728A

United States Patent [19]

Chen et al.

[11] Patent Number: 5,984,728

[45] Date of Patent: Nov. 16, 1999

[54] MULTI-SOCKET ELECTRICITY OUTLET HAVING AT LEAST ONE CIRCUIT PROTECTION MODULE

[75] Inventors: Kuo-Hsiung Chen; Wan-Tsai Shen, both of Hsintien, Taiwan

[73] Assignee: Apollo Resources & Developement Co., LTD, Taipei Hsein, Taiwan

[21] Appl. No.: 09/020,682

[22] Filed: Feb. 9, 1998

[51] Int. Cl.[6] ..... H01R 13/66

[52] U.S. Cl. ..... 439/620; 439/535

[58] Field of Search ..... 439/620, 621, 439/535, 189, 650, 651

[56] References Cited

U.S. PATENT DOCUMENTS 4,799,898 1/1989 Schick ..... 439/418

4,861,286 8/1989 Fosnaugh ..... 439/651

5,292,257 3/1994 Milan ..... 439/214

*Primary Examiner*—Paula Bradley

*Assistant Examiner*—Alexander Gilman

*Attorney, Agent, or Firm*—Kirkpatrick & Lockhart LLP

[57] ABSTRACT

A multi-socket electricity outlet includes a top member and a bottom member with at least one recess defined in an underside thereof. The recess is defined by a casing which extends into the multi-socket electricity outlet. At least one of the top member and the bottom member has an outlet defined therein for an engagement with a plug. The casing has a plurality of first plates extending therefrom At least one module member is replaceably received in the recess and has at least one board replaceably received therein which has a plurality of second plates extending therefrom so as to be connected to the first plates to form a circuit.

6 Claims, 4 Drawing Sheets

MULTI-SOCKET ELECTRICITY OUTLET HAVING AT LEAST ONE CIRCUIT PROTECTION MODULE

BACKGROUND OF THE INVENTION

1. Field of the Invention

The present invention relates to an electric outlet, and, more particularly, to a multi-socket electricity outlet having at least one circuit protection module replaceably disposed therein.

2. Brief Description of the Prior Art

Multi-socket electricity outlets are developed to include a plurality of types of sockets so as to connect various plugs to a single device. Some features such as reducing electromagnetic interference (EMI) and preventing current overload and surge, are required for such devices by users so as to have multi-functions. In order to achieve these requirements, many necessary parts such as EMI filters, non-fuse breakers (NFB) and surge absorbing members are disposed in the multi-socket electricity outlet. However, in some situations, the multi-socket electricity outlet could be damaged because of the above-mentioned reasons and once this multi-socket electricity outlet damage happens, the users generally discard it and buy a new one.

The present invention intends to provide an improved multi-socket electricity outlet which has at least one circuit protection module which is replaceable when needed such that the above-mentioned problems can be mitigated and/or obviated.

SUMMARY OF THE INVENTION

The present invention provides a multi-socket electricity outlet which includes a top member and a bottom member which has at least one recess defined in an underside thereof. At least one of the top member and the bottom member has an outlet defined therein. The recess is defined by a casing which extends into the outlet and a plurality of first plates extending from the casing. At least one module member is replaceably received in the recess and has at least one board replaceably received in the module member. The board has a plurality of second plates extending therefrom so as to be connected to the first plates.

It is an object of the present invention to provide a multi-socket electricity outlet having at least one replaceable module member disposed thereto, the module member having a plurality of plates so as to be connected to sockets of the outlet.

It is another object of the present invention to provide a multi-socket electricity outlet having at least one replaceable module member which has a board received therein and the board has at least one thermal fuse disposed thereto so as to protect the board.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
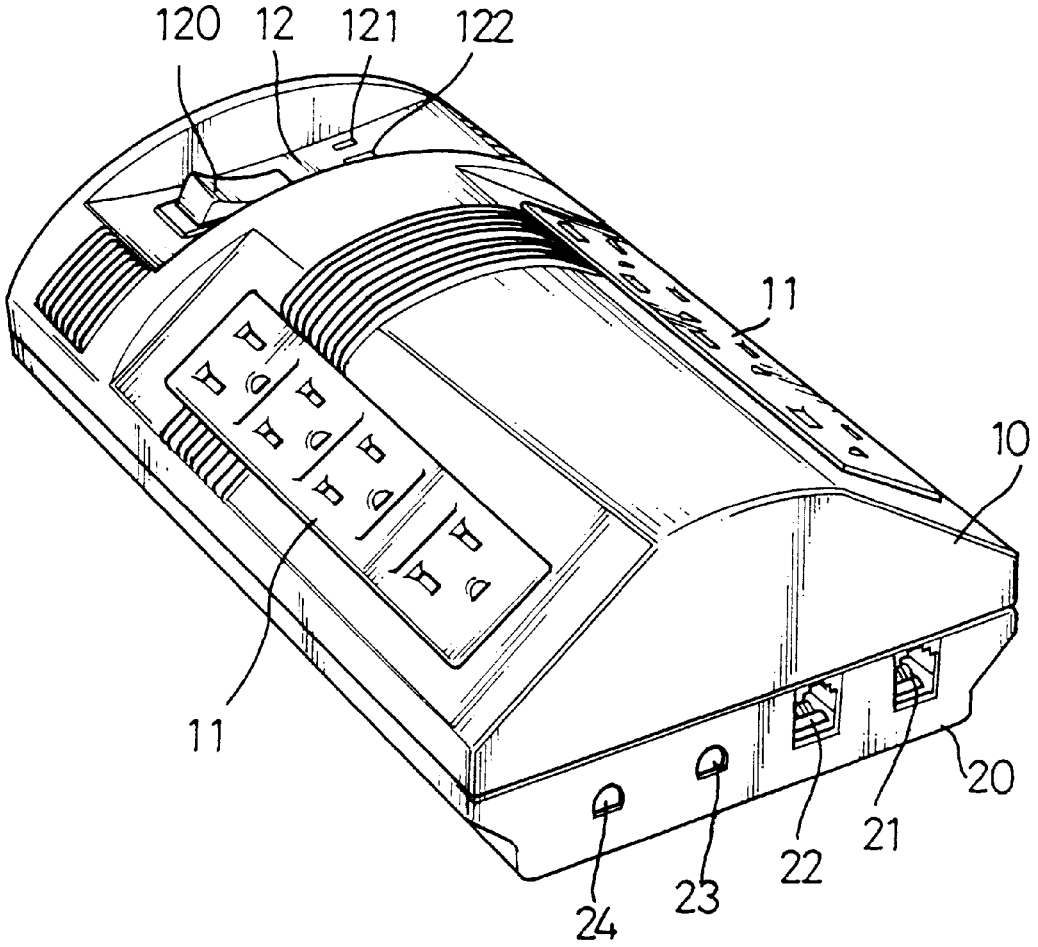
FIG. 1 is a perspective view of a multi-socket electricity outlet in accordance with the present invention.
Figure 2:
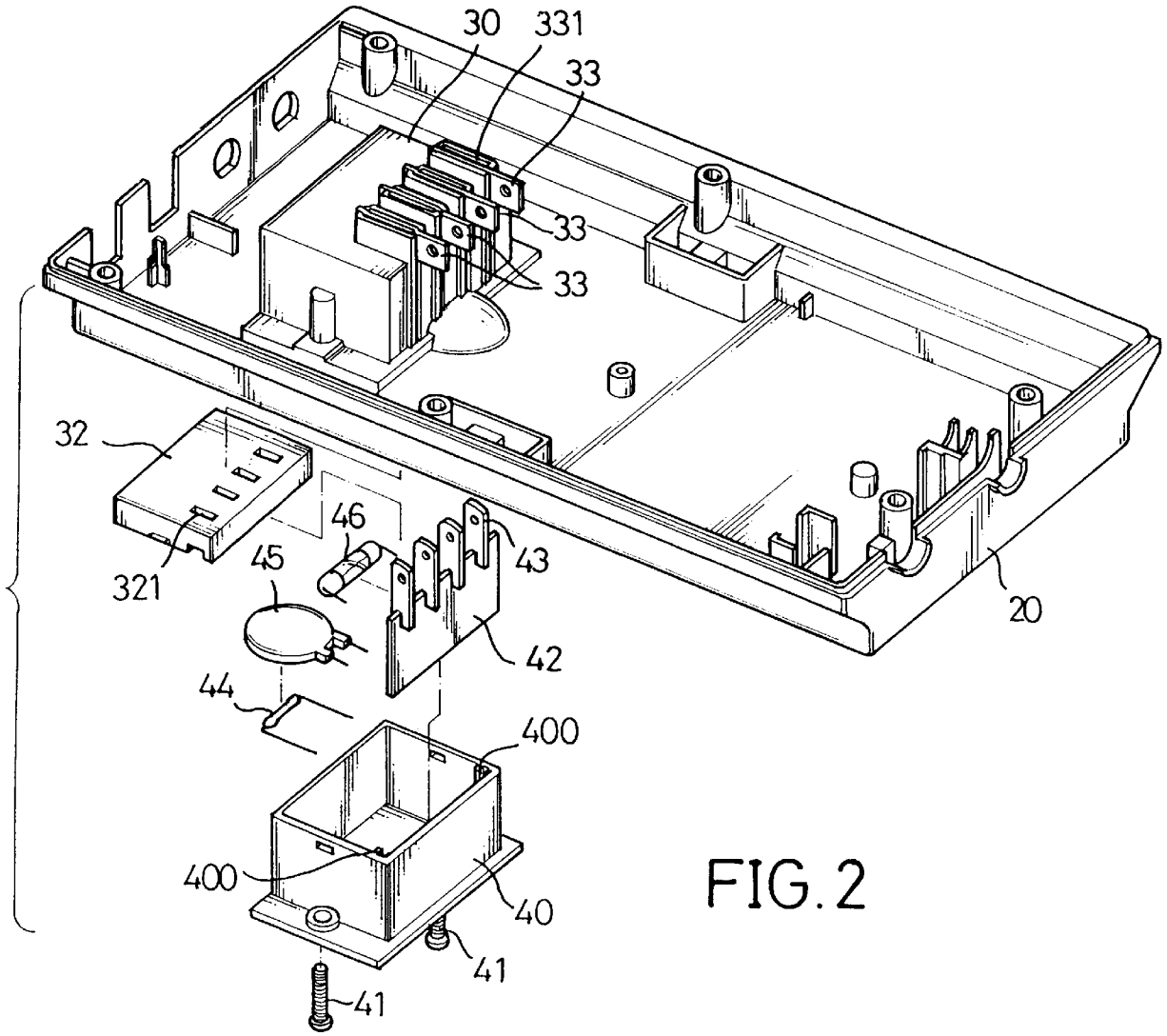
FIG. 2 is an exploded view of a bottom member and a replaceable module member in accordance with the present invention.
Figure 3:
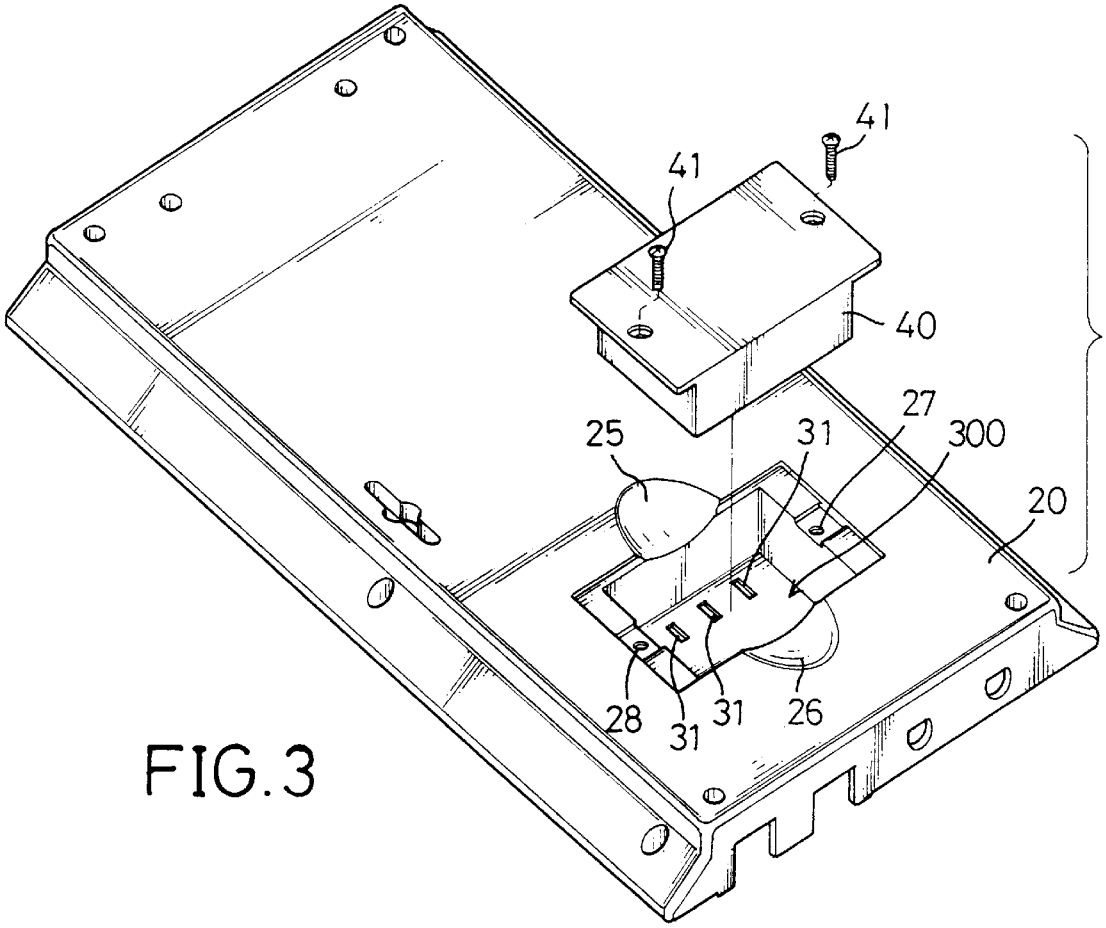
FIG. 3 is a view similar to FIG. 2, viewed from an underside of the bottom member.
Figure 4:
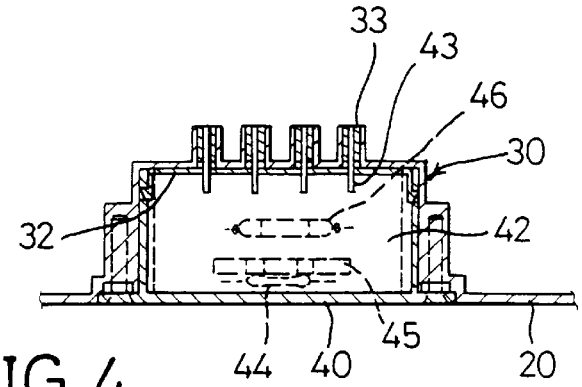
FIG. 4 is a side elevational view, partly in section, of the module member received in a casing in the bottom member with a board received in the module member.

Referring to the drawings and initially to FIGS. 1 through 3, a multi-socket electricity outlet in accordance with the present invention generally includes a top member 10 and a bottom member 20 which is connected to the top member 10 by a known manner such as by screws (not shown). The top member 10 has several first outlets 11 defined in a surface along two sides thereof and a lower surface 12 defined in one of two ends thereof. A switch 120 is disposed in the lower surface 12 and two LEDs (Light Emitting Diodes) 121, 122 are respectively disposed adjacent to the switch 120 so as to indicate a surge condition and an error message.

The bottom member 20 has two jacks 21, 22 and two second outlets 23, 24 respectively defined in one of two end walls thereof, wherein the two jacks 21, 22 are used to be connected to two plugs of telephone lines (not shown) and the two second outlets 23, 24 are used to be connected to cables for a television for example. At least one recess 300 is defined in an underside thereof and two screw holes 27, 28 are defined in the underside of the bottom member 20 and respectively located on two opposite sides defining the recess 300. The bottom member 20 has two access notches 25, 26 defined in two other opposite sides defining the recess 300 and the two access notches 25, 26 respectively communicate with the recess 30. The recess 300 is defined by a casing 30 which extends in the multi-socket electricity outlet. A plurality of first plates 33 extend from a top of the casing 30 in the multi-socket electricity outlet. Each of the first plates 33 has a slot 331 defined in one of two ends thereof in the multi-socket electricity outlet so as to snugly receive a respective second plate 43 which will be mentioned hereinbelow.

A mediate member 32 has a plurality of elongate holes 321 defined therethrough and is disposed to an underside of the top of the casing 30. The elongated holes 321 align respectively with the slots 331.

At least one module member 40 is replaceably received in the recess 300 and has two rails 400 respectively formed on two opposite inner sides thereof so as to replaceably receive a board 42 therebetween. The module member 40 is fixedly received in the recess 300 by threadedly extending two screws 41 through the module member 40 to threadedly engage in the screw holes 27, 28 in the bottom member 20. The board 42 has a plurality of the second plates 43 extending therefrom so as to be respectively inserted into the: respective slots 331 in the casing 30 via the elongated holes 321. The board 42 has a thermal fuse 44 and an ordinary fuse 46 respectively disposed to the board 42 wherein the thermal fuse 44 is located to abut a varistor 45 disposed to the board 42. Therefore, when the LED 121 is off and/or the LED 122 is on, a user may remove the module member 40 from the bottom member 20 to apply proper processes thereto. The two access notches 25, 26 allow the user's fingers to hold the module member 40 to remove it from the recess 300.

Figure 5:
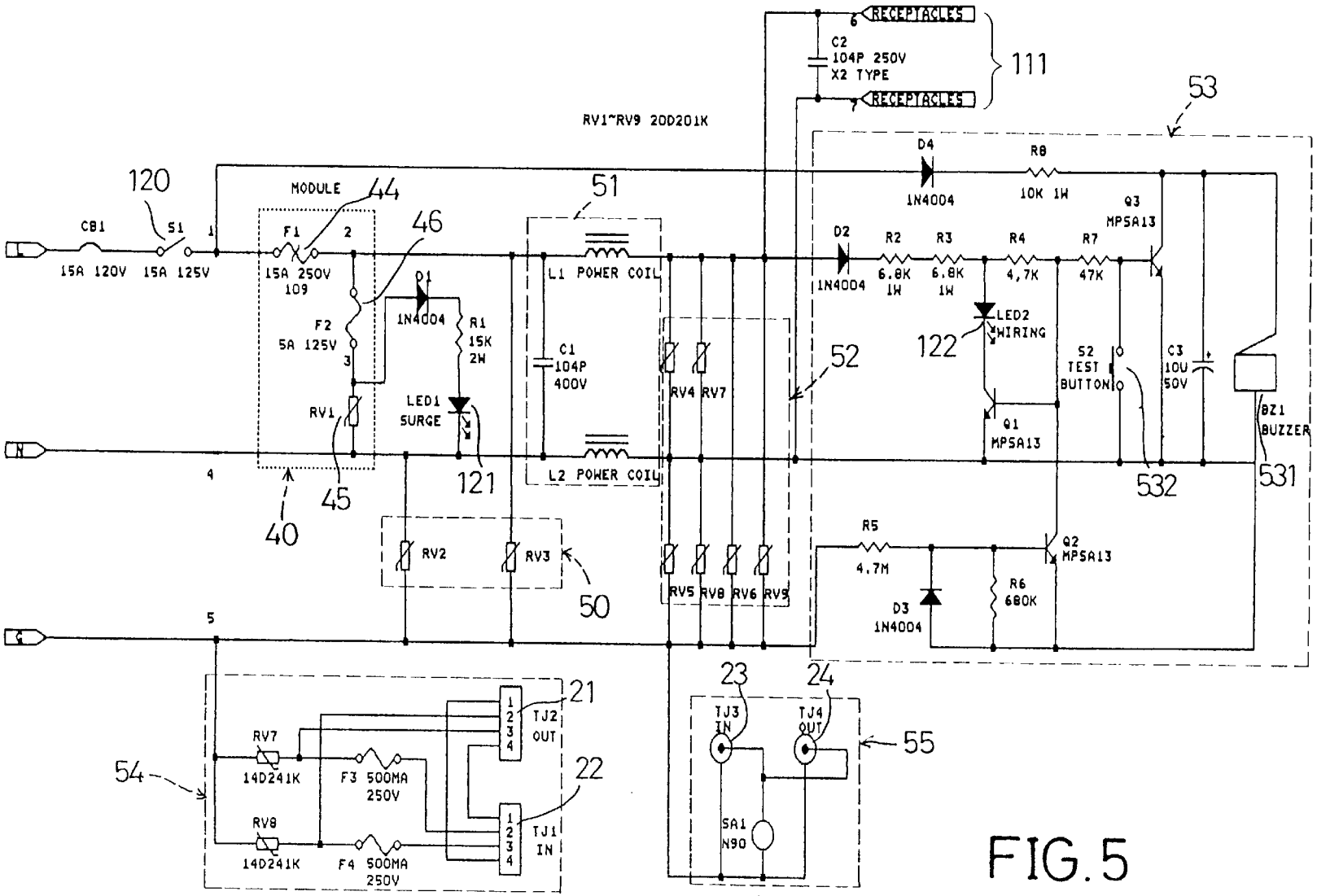
FIG. 5 is a circuit diagram of the multi-socket electricity outlet of the present invention.

Referring to FIG. 5, a circuit used in the multi-socket electricity outlet of the invention is shown, and the circuit comprises the switch 120, the module member 40, a first surge suppression circuit 50, an EMI filter 51, a second surge suppression circuit 52, an alerter circuit 53, a first protective circuit 54 and a second protective circuit 55.

The module member 40 is formed by the thermal fuse 44, the ordinary fuse 46, and the varistor 45. The first and second surge suppression circuits 50, 52 are respectively formed by a plurality of varistors. The LED 121 for indicating a surge is connected between the module member 40 and the first surge suppression circuit 50. A pair of output terminals 111 for the receptacles are connected to the second surge suppression circuit 52. The EMI filter 51 is formed bad two inductors and a capacitors. The alerter circuit 53 comprises the LED 122 for indicating a wiring fault, a buzzer 531, and a test button 532. The first protective circuit 54 is connected with the two jacks 21, 22, and the second protective circuit 55 is connected with the two outlets 23, 24.

Preferably, the thermal fuse 44 is designed to be directly attached to the varistor 45. When a large surge current enters the module member 40, the temperature of the varistor 45 significantly increases, and the thermal fuse 44 will burn out if the temperature of the varistor 45 is higher than the rating temperature of the thermal fuse 44. When the thermal fuse 44 burns out, the LED 121 will go out. When the LED 121 has gone out, the user is aware that the module member 40 must be replaced.

Although the invention has been explained in relation to its preferred embodiment, it is to be understood that many other possible modifications and variations can be made without departing from the spirit and scope of the invention as hereinafter claimed.

What is claimed is:

1. A multi-socket electricity outlet comprising:

a top member and a bottom member which has at least one recess defined in an uwderside thereof, at least one of said top member and said bottom member having an outlet defined therein, said recess defined by a casing which extends into said multi-socket electricity outlet, and a plurality of first plates extending from said casing, said bottom member having two access notches defined in said underside thereof, each said access notch communicating said recess, and at least one module member replaceably received in said recess and having at least one board replaceably received in said module member, said board having a plurality of second plates extending therefrom so as to be connected to said first plates.

2. The multi-socket electricity outlet as claimed in claim 1 wherein said module member has two rails respectively formed on two opposite inner sides thereof so as to receive said board therebetween.

3. The multi-socket electricity outlet as claimed in claim 1 wherein said module member is fixedly received in said recess by extending at least one screw through said module member to threadedly engage in said bottom member.

4. The multi-socket electricity outlet as claimed in claim 1 wherein each of said first plates has a slot defined in one of two ends thereof so as to snugly receive said respective second plate.

5. The multi-socket electricity outlet as claimed in claim 1 wherein said board has a varistor disposed thereto.

6. The multi-socket electricity outlet as claimed in claim 5 wherein said board has a thermal fuse which abuts said varistor.

* * * * *